US008033029B2

(12) United States Patent
Johnston et al.

(10) Patent No.: US 8,033,029 B2
(45) Date of Patent: Oct. 11, 2011

(54) MULTI-REEL MARKING APPARATUS

(75) Inventors: John E Johnston, Redwood City, CA (US); Wilfred Anderson, Los Gatos, CA (US); Andrew Butler, Palo Alto, CA (US); David H Titzler, Bellevue, WA (US); Edward J Cooper, Lafayette, CA (US); Christopher Tackind, Menlo Park, CA (US); Heather Fleming, Menlo Park, CA (US)

(73) Assignee: Design to Manufacturing, Inc., Mountain View, CA (US)

( * ) Notice: Subject to any disclaimer, the term of this patent is extended or adjusted under 35 U.S.C. 154(b) by 226 days.

(21) Appl. No.: 11/959,854

(22) Filed: Dec. 19, 2007

(65) Prior Publication Data

US 2009/0158606 A1 Jun. 25, 2009

(51) Int. Cl.
*B44D 3/38* (2006.01)

(52) U.S. Cl. ..... 33/414; 33/413

(58) Field of Classification Search ..... 33/414, 33/755, 756, 764, 413
See application file for complete search history.

(56) References Cited

U.S. PATENT DOCUMENTS

| | | | | |
|---|---|---|---|---|
| 208,346 | A * | 9/1878 | Taylor | 33/764 |
| 3,046,663 | A * | 7/1962 | Romero | 33/414 |
| 3,078,581 | A * | 2/1963 | Foster | 33/414 |
| 3,126,637 | A * | 3/1964 | Short | 33/414 |
| 3,206,855 | A * | 9/1965 | Fletcher | 33/414 |
| 6,167,632 | B1 * | 1/2001 | Shor | 33/414 |
| 7,331,116 | B1 * | 2/2008 | Johnston et al. | 33/414 |

* cited by examiner

*Primary Examiner* — Christopher Fulton
(74) *Attorney, Agent, or Firm* — Jeffrey Schox

(57) ABSTRACT

A multi-line chalk reel is disclosed that may be comprised of three or more line reels disposed in a polar arrangement of parallel but distinct rotation axes that has a single method for engaging and disengaging a single drive arrangement to any one spool. This arrangement provides a variety of advantages, including a package solution of useful dimensions and a low part count to minimize parts in assembly. The single drive arrangement reduces cost, and provides for convenient access to individual spools.

21 Claims, 5 Drawing Sheets

MULTI-REEL MARKING APPARATUS

CROSS REFERENCE TO RELATED APPLICATION

This application claims priority to Provisional Application Ser. No. 60/733,899, filed on Nov. 3, 2005 and U.S. Pat. No. 7,331,116, filed Nov. 3, 2006.

FIELD OF THE DISCLOSURE

The present disclosure relates generally to measurement tools, and in particular to marking tools.

BACKGROUND

Chalk lines are commonly used in the construction and building trades for marking measurements. It is common practice in construction layout to apply lines of differing colors and widths to differentiate the purpose of marks made. Repairing broken chalk line on a single reel can take time away from constructive working time. For these and other reasons, it is a common practice for builders familiar with such methods to carry multiple chalk line reels. Likewise, the advantage of integrating a winding advantage to collect deployed line back onto the chalk line spool is well established in the art and practice.

A number of dual and multiple reel chalk line inventions may be found in the prior art, typically embodied as an arrangement of spools in which a single handle may drive a stack of axially aligned spools and allow selective engagement of a spool through various means. However, these arrangements have certain disadvantages. For example, stacked spool arrangements may result in an over-wide package solution. Additionally, stacked spool arrangements necessitate the need for additional internal walls to separate chalk volumes.

Alternately, prior art spools may be mounted on separate axis and coupled to distinct means so that the use of any spool is selected by changing from one handle to another. The need to supply separate drive means for each spool significantly increases the necessary production cost of a multi-reel product and is generally inconvenient to use.

DETAILED DESCRIPTION

Embodiments of the present invention described in the following detailed description are directed at virtual agents. Those of ordinary skill in the art will realize that the detailed description is illustrative only and is not intended to restrict the scope of the claimed inventions in any way. Other embodiments of the present invention, beyond those embodiments described in the detailed description, will readily suggest themselves to those of ordinary skill in the art having the benefit of this disclosure. Reference will now be made in detail to implementations of the present invention as illustrated in the accompanying drawings. Where appropriate, the same reference indicators will be used throughout the drawings and the following detailed description to refer to the same or similar parts.

In the interest of clarity, not all of the routine features of the implementations described herein are shown and described. It will, of course, be appreciated that in the development of any such actual implementation, numerous implementation-specific decisions must be made in order to achieve the developer's specific goals, such as compliance with application- and business-related constraints, and that these specific goals will vary from one implementation to another and from one developer to another. Moreover, it will be appreciated that such a development effort might be complex and time-consuming, but would nevertheless be a routine undertaking of engineering for those of ordinary skill in the art having the benefit of this disclosure.

Figure 1:
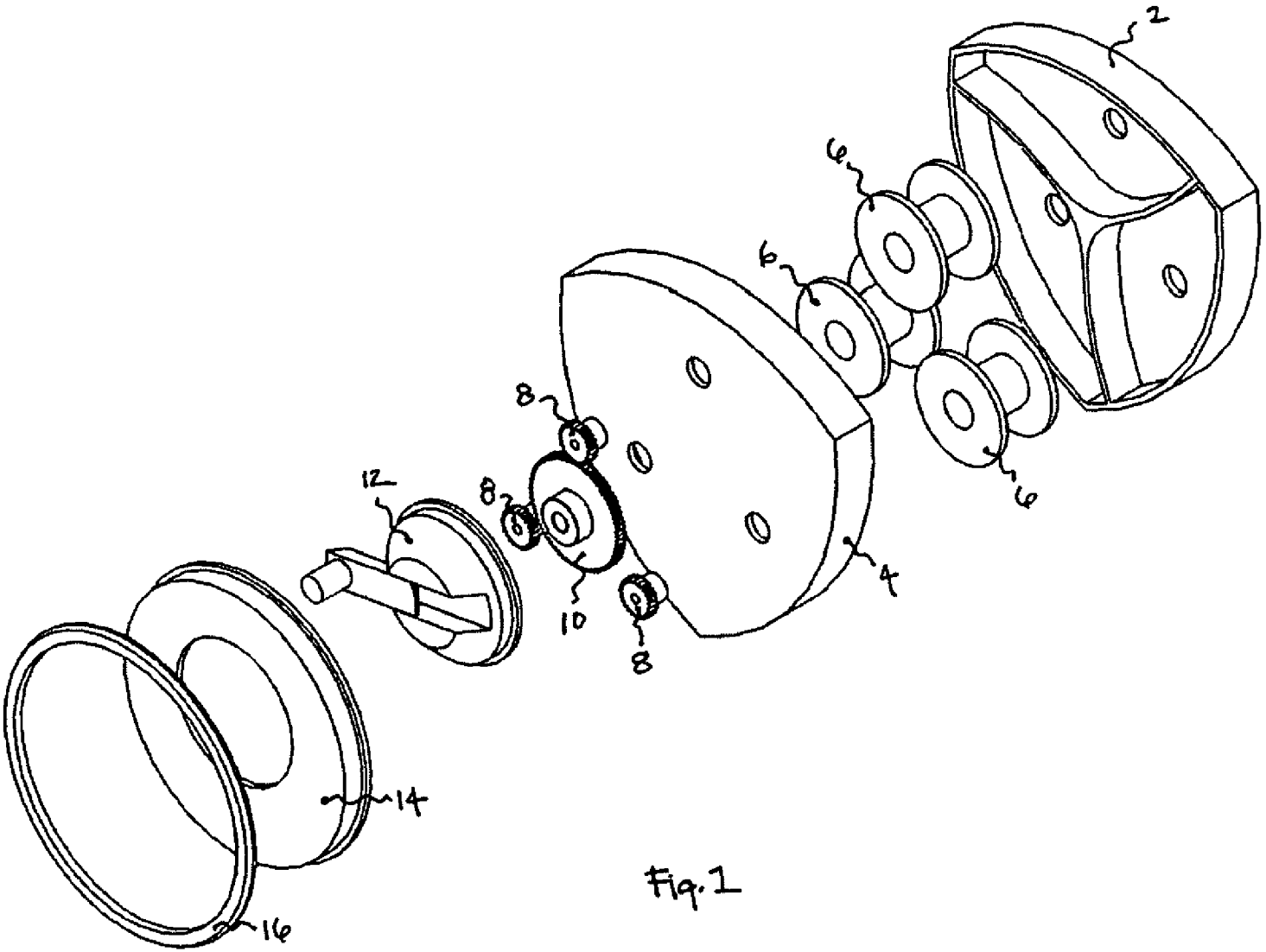
FIG. 1 is an exploded oblique view of one embodiment of a multi-reel chalk line in accordance with this disclosure.

FIG. 1 shows an exploded view of one embodiment of a multi-reel chalk line utilizing a polar arrangement of spools 6 captured in a chalk tight enclosure made up of a lower housing 2 and upper housing 4. Each spool is attached to a corresponding spur gear 8. Alternately, the spur gear feature can be contained in the spool 6 as a single part. Chalk filling, line access and sealing can be included by means common in the art and are not illustrated.

In this first embodiment, a drive gear 10 is attached to a handle assembly 12 and captured by a selector disk 14 and clamping ring 16. The selector disk 14 rotates about a virtual axis defined by the clamping ring 16. The clamping ring 16 fixes the selector ring 14, handle assembly 12 and drive gear 10 in relation to the chalk enclosure assembly, spools 6 and spur gears 8.

Figure 2:
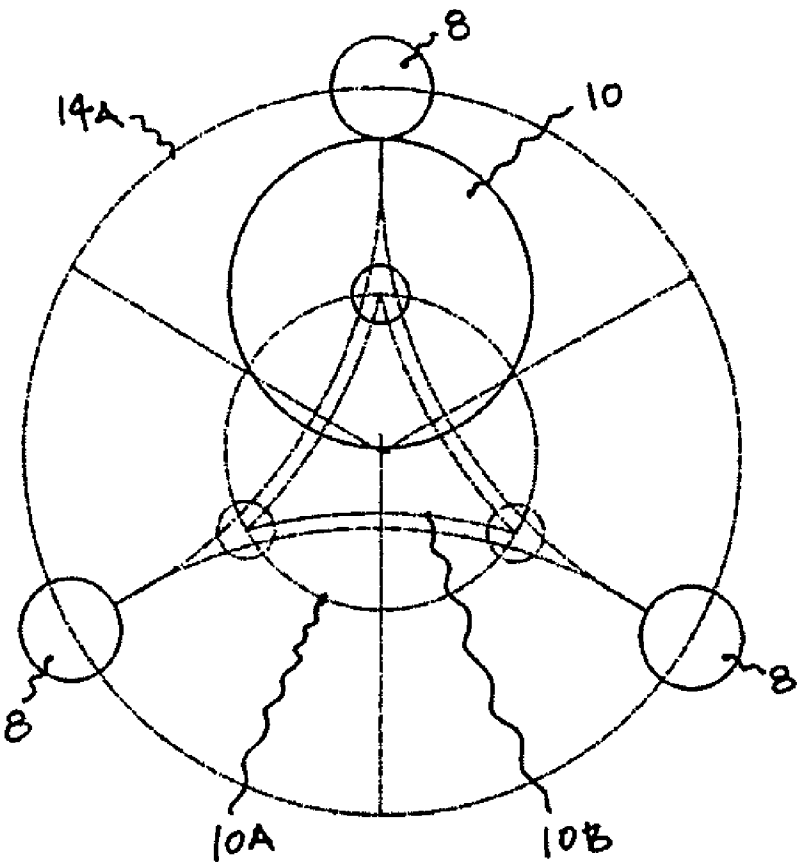
FIG. 2 is a front view of the first embodiment gear arrangement, and diagram of possible gear paths in accordance with this disclosure.
Figure 2:
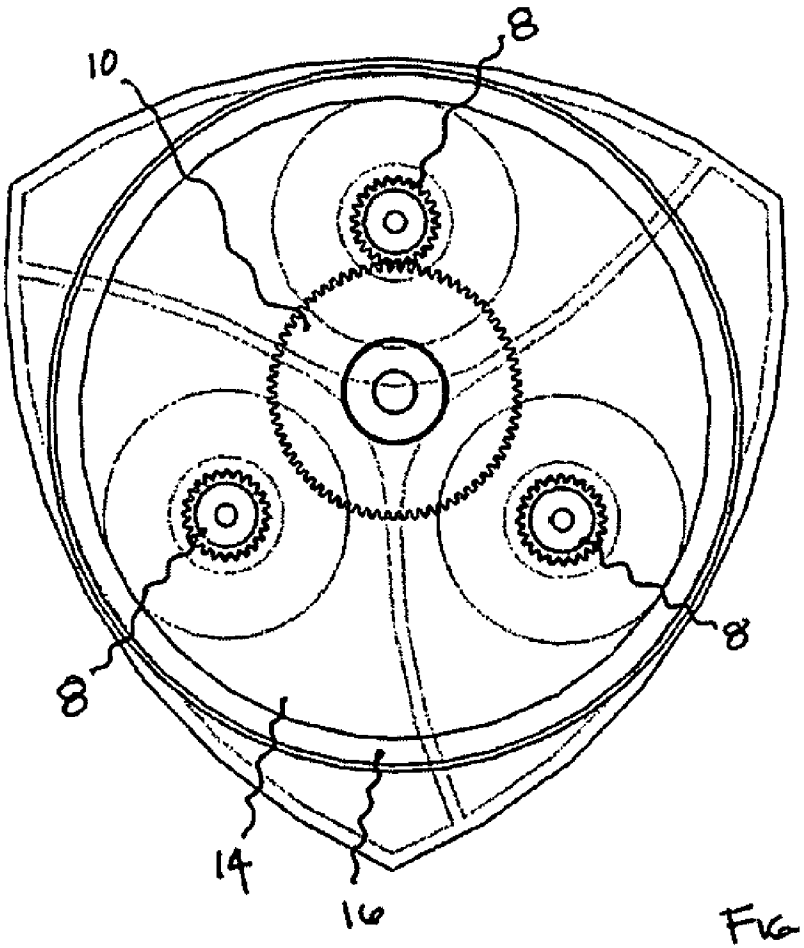

FIG. 2 shows a front view illustrating the arrangement of spur gears 8, selector disk 14, clamping ring 16 and drive gear 10. The spur gears 8 each rotate about an axis common with a respective spool 6. The spur gears 8 and spools 6 are arranged in the assembly such that they are equidistant from the virtual axis of the selector disk 14 and clamping ring 16. The drive gear 10 and handle assembly 12 are fixed so that they share a common axis of rotation. The axis of rotation of the drive gear 10 is offset from the virtual axis of rotation of the selector disk 14 so that the drive gear 10 will engage with each spur gear 8 at a discreet position as the selector disk 14 is turned about its' axis of rotation.

The diagram in FIG. 2 shows two possible paths that the drive gear 10 can follow as the selector disk 14 rotates. Path 10A is a simple circular path. Path 10B represents one possible complex path of many possible paths that may be employed to engage and disengage the drive gear 10 from each spur gear 8 at distinct positions as the selector disk 14 is rotated.

Figure 3A:
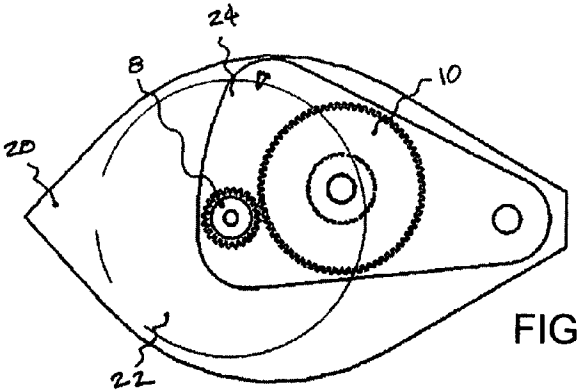
FIGS. 3A-C represent a sequenced illustration of single reel embodiment of selection means in accordance with this disclosure.
Figure 3B:
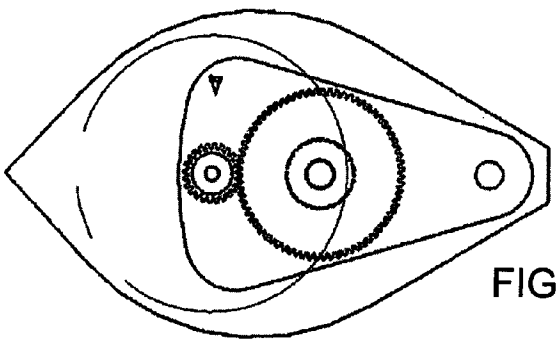
Figure 3C:
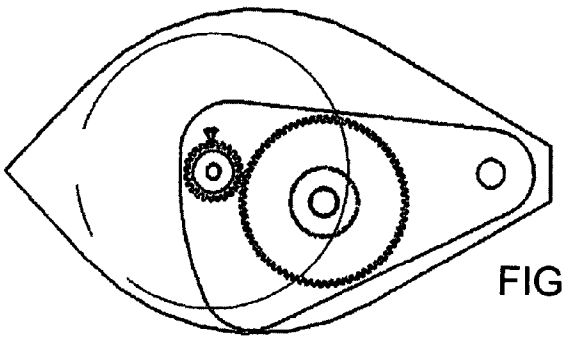

The method of rotating a drive gear 10 into engagement and disengagement with a coupling spur gear 8 is not limited in utility to a multi-reel configuration. FIG. 3 shows one possible embodiment of a single spool or shared axis multi-spool configuration. In FIG. 3A a drive gear 10 is fixed to a rotating selector arm 24. The selector arm 24 is positioned so that the spur gear 8 is free to rotate. In FIG. 3B the selector arm 24 is rotated down to engage the drive gear 10 with the spur gear 8. In FIG. 3C the selector arm is further rotated down so that the drive gear 10 is disengaged with the spur gear 8. In FIG. 3C a tooth feature 21 of the selector arm 24 is shown engaging the spur gear as means of preventing the spur gear 8 from rotating. These positions may be distinct and held by detent of other common means. Alternately, the positions shown in FIG. 3 may be momentary positions with means of automatically returning to a predetermined position once a user releases the mechanism.

Figure 4:
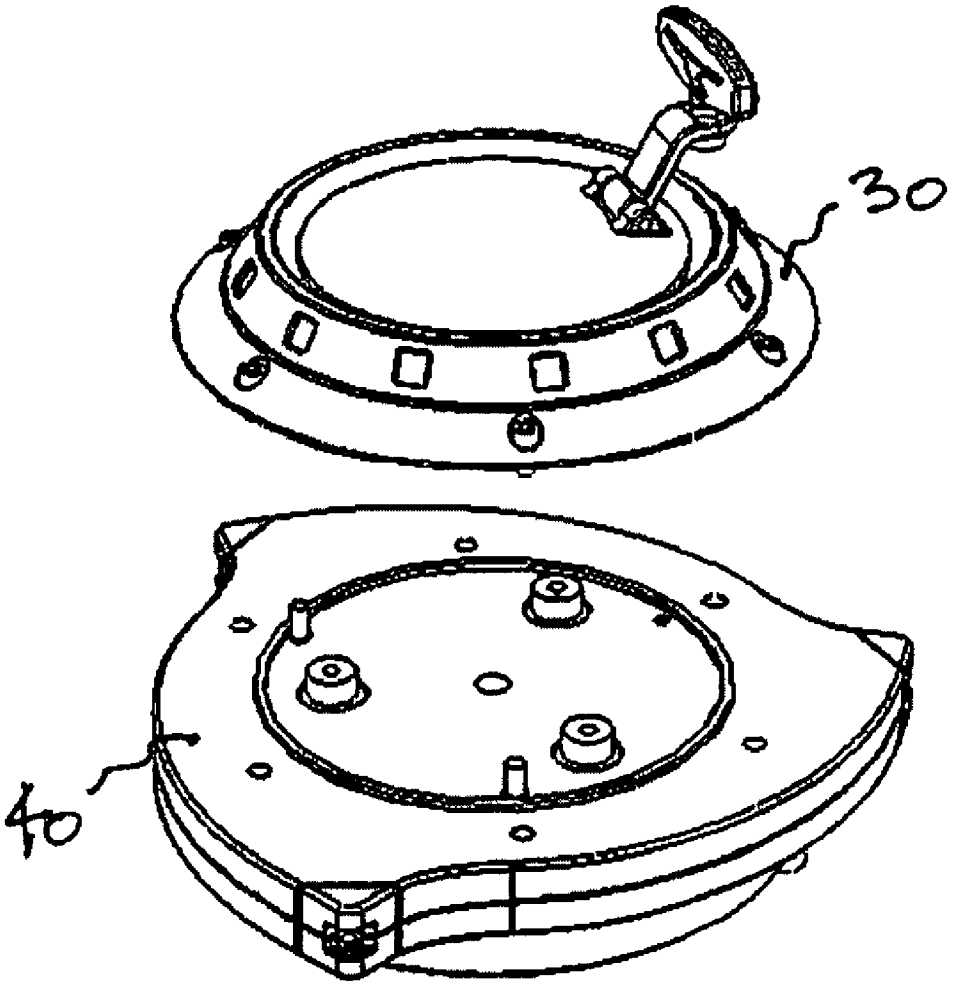
FIG. 4 is an exploded oblique view of a second embodiment of a multi-reel chalk line in accordance with this disclosure.
Figure 6:
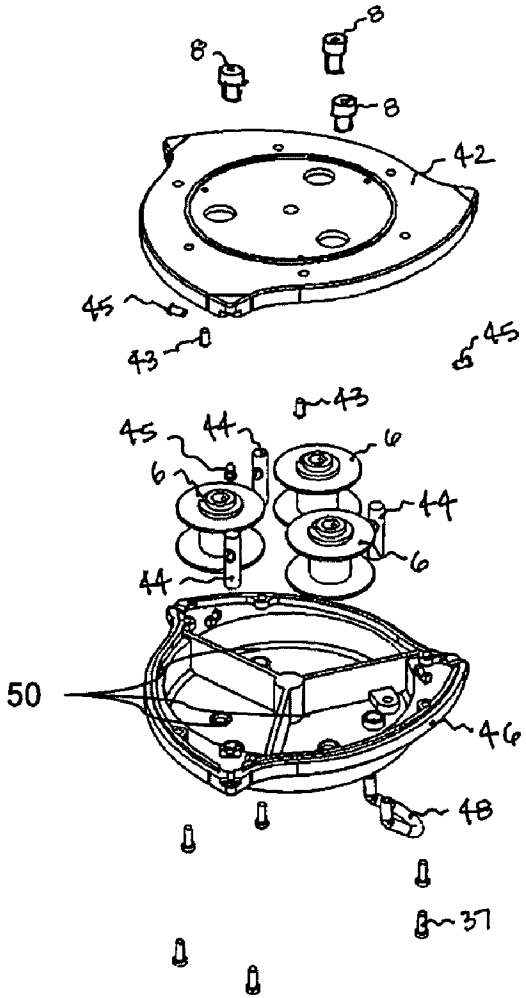
FIG. 6 is an exploded oblique view of the second embodiment reel case assembly in accordance with this disclosure.
Figure 5:
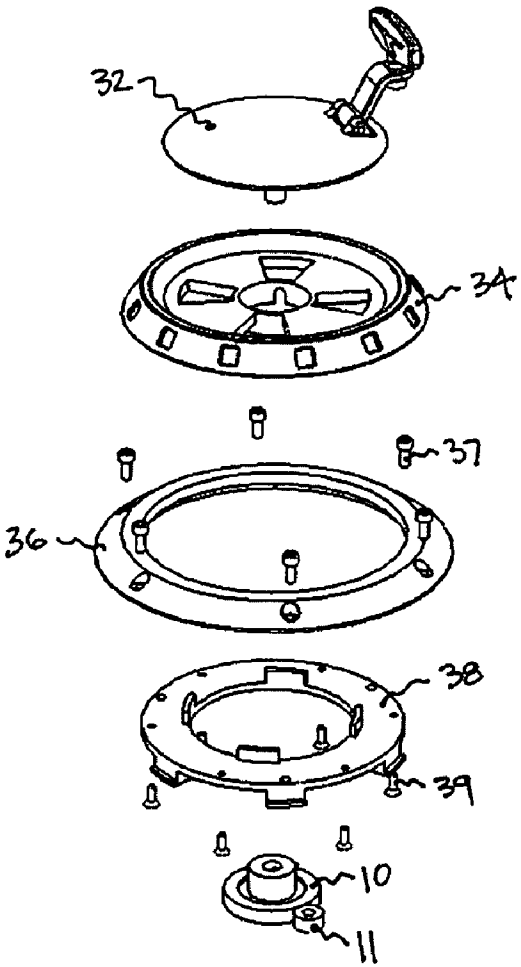
FIG. 5 is an exploded oblique view of the second embodiment drive assembly in accordance with this disclosure.

FIGS. 4, 5 and 6 show a second embodiment of a multi-reel chalk line with a polar arrangement of spools 6 captured in a lower housing 46 and upper housing 42, making up a compartmented chalk & reel housing assembly 40. A drive arrangement assembly 30 provides means of coupling one handle, to a select spool.

FIG. 5 shows an exploded oblique view of the second embodiment of the drive arrangement assembly 30. In this second embodiment, a traveler gear 11 is coupled to a selector ring 34. The drive gear 10 is fixably attached to a handle assembly 32 and rotates about a common center axis. The selector ring 34 and a capture ring 38 traps the clamping ring 36. The clamping ring 36 provides means to fixably attach the drive arrangement assembly 30 to the housing assembly 40. The selector ring 34 holds the traveler gear 11 engaged to the drive gear 10. Rotating the selector ring 34 moves the traveler gear 11 into engagement with each spur gear 8 at a discreet position.

FIG. 6 shows an exploded isometric view of the housing assembly 40. The housing assembly three reels 6 trapped in a lower housing 46 and upper housing 42. Features of the housing parts 46, 42 create separated compartments for each spool with a single pass-out for line utilizing means common in single spool chalk enclosure.

FIG. 6 shows an accessory loop 48 attached to the housing assembly 40. Such a loop may be useful in transporting the tool through attachment of a clip, carabineer, lanyard, strap or a variety of other means. The loop 48 is configured allow the device to be attached to a belt, belt loop or other convenient point. The loop 48 is shaped to hold the device away from a users hip such that it will be comfortable and convenient to wear while walking. Such a feature may integrate features of the aforementioned attachments. Alternately, the housing 40 may employ a variety of means such as clips, magnets and other common methods for stowing and transporting similar tools.

Additional variations and embodiments of this invention can be created. The spur gear 8 may be integrated to the spool part 6. The selector ring 34 and capture ring may be integrated into one part or be otherwise designed in a variety of geometries. An assembly may have more than three reels. The reel may contain and deploy wound materials other than chalk lines. The invention could be made to house an ink line, dry line or a tape measure, a cord saw or a variety of other tool configurations. The handle assembly 32 may be embodied as a motor assembly 33, as shown in FIG. 7, an adaptor for outside drive means, or a variety of other methods.

As will now be appreciated, a new and novel multi-line chalk reel has been disclosed that provides many benefits over the devices of the prior art. The multi-line chalk reel as disclosed may be comprised of three or more line reels disposed in a polar arrangement of parallel but distinct rotation axes that has a single method for engaging and disengaging a single drive arrangement to any one spool. This arrangement provides a variety of advantages, including a package solution of useful dimensions and a low part count to minimize parts in assembly. The single drive arrangement reduces cost, and provides for convenient access to individual spools.

The housing provides for flexible arrangement of line exits to facilitate convenient use of lines, the means to conveniently set spools in locked, engaged and freewheel states. The disclosed reel provides for a drive arrangement allowing integration of a winding advantage feature, and allows for uninterrupted use of tool when one lines breaks, and a single means of engaging and disengaging drive arrangement to spools provides for greater convenience and ease of use.

The disclosed reel provides for convenient use of multiple line colors in single tool, different line weights in single tool, and for integration of non-chalked lines in single tool, including but not limited to ink lines, dry lines, measuring tapes, cord saw or other common flexible tools.

While embodiments and applications of this invention have been shown and described, it will now be apparent to those skilled in the art having the benefit of this disclosure that many more modifications than mentioned above are possible without departing from the inventive concepts disclosed herein.

We claim:

1. A marking apparatus comprising:

a housing including a selector that rotates about a selector axis and a handle that rotates about a handle axis;

a reel disposed in the housing; and an engaging mechanism coupled to the handle and to the selector;

wherein the selector rotates about the selector axis to engage the reel to the engaging mechanism, and wherein engagement of the reel to the engaging mechanism allows the rotation of the handle to cause rotation of the reel about an axis substantially parallel to and separate from the selector axis.

2. The marking apparatus of claim 1, wherein the engaging mechanism includes a spur gear coupled to the reel and a drive gear coupled to the handle, wherein the selector engages the reel to the engaging mechanism by engaging the spur gear to the drive gear, and wherein the rotation movement of the handle causes rotation of the drive gear and rotation of the engaged spur gear and the reel.

3. The marking apparatus of claim 2, wherein the handle axis is substantially parallel to and separate from the selector axis.

4. The marking apparatus of claim 2, wherein the drive gear is coupled to the selector and rotates about the selector axis.

5. The marking apparatus of claim 4, wherein the drive gear travels along an arc as the selector rotates about the selector axis, wherein the arc includes a first location where the drive gear is engaged to the spur gear and a second location where the drive gear is not engaged to the spur gear.

6. The marking apparatus of claim 5, further comprising a second reel disposed in the housing and a second spur gear coupled to the second reel, wherein the arc further includes a third location where the drive gear is engaged to the second spur gear.

7. The marking apparatus of claim 5, wherein the arc is centered about the selector axis.

8. The marking apparatus of claim 2, wherein the spur gear is integrated with the reel.

9. The marking apparatus of claim 1, further comprising chalk line wound around the reel.

10. The marking apparatus of claim 1, further comprising a flexible material wound around the reel selected from the group consisting of: ink line, dry line, tape measure, and cord saw.

11. The marking apparatus of claim 1, wherein the handle is coupled to a motor assembly that moves the handle.

12. The marking apparatus of claim 1, wherein the selector includes a locking element that engages with the reel and prevents rotation of the reel.

13. The marking apparatus of claim 12, wherein the selector rotates about the selector axis, disengages the locking element from the reel, and engages the reel to the engaging mechanism.

14. The marking apparatus of claim 1, further comprising a second reel disposed in the housing, wherein the selector engages a select one of the reel and the second reel to the engaging mechanism.

15. The marking apparatus of claim 14, wherein the first and second reels are substantially identical.

16. The marking apparatus of claim 14, wherein the reel and the second reel are arranged radially equidistant around the selector axis and are both disposed within the housing along substantially the same plane.

17. The marking apparatus of claim 14, wherein the housing isolates the reel from the second reel.

18. The marking apparatus of claim 17, wherein the housing includes compartments to isolate the reel from the second reel.

19. The marking apparatus of claim 1, further comprising an accessory coupler, wherein the accessory coupler couples the marking apparatus to an accessory.

20. The marking apparatus of claim 19, wherein the accessory coupler couples the marking apparatus to the belt of the user.

21. The marking apparatus of claim 19, wherein the accessory coupler is a loop.

* * * * *

UNITED STATES PATENT AND TRADEMARK OFFICE

CERTIFICATE OF CORRECTION

PATENT NO. : 8,033,029 B2
APPLICATION NO. : 11/959854
DATED : October 11, 2011
INVENTOR(S) : John E Johnston et al.

It is certified that error appears in the above-identified patent and that said Letters Patent is hereby corrected as shown below:

In column 4, line 38, "the drive gear, and wherein rotation movement of the" should read --the drive gear, and wherein rotation of the--

Signed and Sealed this
Twentieth Day of December, 2011

David J. Kappos

David J. Kappos
*Director of the United States Patent and Trademark Office*